US008793939B2

(12) United States Patent
Landry et al.

(10) Patent No.: US 8,793,939 B2
(45) Date of Patent: Aug. 5, 2014

(54) ELEVATOR SYSTEM AND INSTALLATION METHOD

(75) Inventors: Thomas E. Landry, Canton, CT (US); Harold Terry, Avon, CT (US); Richard J. Ericson, Southington, CT (US); Leandre Adifon, Farmington, CT (US); Stephen R. Nichols, Unionville, CT (US)

(73) Assignee: Otis Elevator Company, Farmington, CT (US)

( * ) Notice: Subject to any disclaimer, the term of this patent is extended or adjusted under 35 U.S.C. 154(b) by 313 days.

(21) Appl. No.: 13/132,667

(22) PCT Filed: Dec. 5, 2008

(86) PCT No.: PCT/US2008/085644
§ 371 (c)(1),
(2), (4) Date: Jun. 3, 2011

(87) PCT Pub. No.: WO2010/065040
PCT Pub. Date: Jun. 10, 2010

(65) Prior Publication Data

US 2011/0240828 A1 Oct. 6, 2011

(51) Int. Cl.
*B66B 9/00* (2006.01)
*E04H 6/06* (2006.01)

(52) U.S. Cl.
USPC ..... 52/30; 187/412; 187/406; 187/213; 187/407; 187/216

(58) Field of Classification Search
USPC ..... 52/29, 30; 187/256, 266, 249, 406, 407, 187/408, 404, 382, 383, 313, 412, 216
See application file for complete search history.

(56) References Cited

U.S. PATENT DOCUMENTS

| | | | | |
|---|---|---|---|---|
| 3,878,916 | A * | 4/1975 | White, Jr. | 182/145 |
| 3,882,968 | A * | 5/1975 | Suozzo | 187/264 |
| 4,664,230 | A * | 5/1987 | Olsen | 187/255 |
| 5,020,641 | A * | 6/1991 | Olsen et al. | 187/408 |
| 5,899,300 | A * | 5/1999 | Miller et al. | 187/256 |
| 6,006,865 | A | 12/1999 | Ammon | |
| 6,085,874 | A * | 7/2000 | Uchino et al. | 187/404 |
| 6,193,017 | B1 | 2/2001 | Koster | |
| 6,446,762 | B1 | 9/2002 | St. Pierre et al. | |

(Continued)

FOREIGN PATENT DOCUMENTS

| | | |
|---|---|---|
| EP | 1327597 A1 | 7/2003 |
| EP | 1329411 A1 | 7/2003 |

(Continued)

OTHER PUBLICATIONS

International Preliminary Report on Patentability for International application No. PCT/US2008/085644 mailed Jun. 16, 2011.

(Continued)

*Primary Examiner* — Chi Q Nguyen
(74) *Attorney, Agent, or Firm* — Carlson, Gaskey & Olds

(57) ABSTRACT

An exemplary mounting arrangement for an elevator machine comprises a first portion (32) and a second portion (34). The first portion and the second portion are moveable relative to each other between a shipping position and a deployed position in which the first portion and the second portion are generally perpendicular to each other.

22 Claims, 8 Drawing Sheets

(56) References Cited

U.S. PATENT DOCUMENTS

| | | | | |
|---|---|---|---|---|
| 6,655,500 | B2 * | 12/2003 | Orrman et al. | 187/254 |
| 6,782,975 | B1 * | 8/2004 | Whittur | 187/240 |
| 6,851,519 | B2 * | 2/2005 | Ach et al. | 187/266 |
| 7,150,342 | B2 * | 12/2006 | Adifon et al. | 187/411 |
| 7,261,184 | B2 * | 8/2007 | Bass et al. | 187/242 |
| 7,364,019 | B2 | 4/2008 | Faletto | |
| 7,383,924 | B2 | 6/2008 | Izumi et al. | |
| 2005/0087397 | A1 | 4/2005 | Faletto | |
| 2005/0275161 | A1 | 12/2005 | Fischer | |

FOREIGN PATENT DOCUMENTS

| | | | |
|---|---|---|---|
| EP | 1081085 | B1 | 10/2003 |
| EP | 1568644 | A1 | 8/2005 |
| EP | 1266859 | B1 | 10/2006 |
| EP | 1520831 | B1 | 4/2007 |
| JP | 11180655 | A | 7/1999 |
| JP | 2002128415 | A | 5/2002 |
| WO | 9943596 | | 9/1999 |
| WO | 03048020 | A1 | 6/2003 |
| WO | 2004069715 | A1 | 8/2004 |
| WO | 2005007552 | A1 | 1/2005 |

OTHER PUBLICATIONS

International Search Report and Written Opinion of the International Searching Authority for International Application No. PCT/US2008/085644 mailed May 8, 2009.

Supplementary Search for Chinese Patent Application No. 200880132267.9 dated Jan. 10, 2014.

* cited by examiner

ELEVATOR SYSTEM AND INSTALLATION METHOD

BACKGROUND

Elevators carry passengers, cargo or both between different levels in a building, for example. There are different mechanisms for moving an elevator car within a hoistway. Traction-based elevator systems utilize a roping arrangement for suspending the elevator car and moving the car as desired. Most traction based systems include a counterweight.

Traditionally, traction based elevator systems included a machine room in which the elevator machine, drive and control components were located. For example, a separate structural room would be placed on top of a hoistway on a roof of a building. The machine room provides access to the motor, brake, drive and controller components for service and maintenance operations, for example.

A modern trend in elevator systems has been to eliminate the machine room and provide a machine roomless elevator system. Eliminating the machine room provides the advantage reducing construction cost otherwise associated with providing a separate machine room, for example. While there are advantages associated with eliminating the requirement for a machine room, certain challenges are introduced.

For example, strategic placement of the elevator components is required to provide an adequate machine support that also supports the loads of the elevator system. At the same time, the desire is to keep cost down and to minimize the complexity of the installation process. Another issue that is presented by machine roomless elevator systems is that a technician or mechanic may need to enter the hoistway for maintenance or service procedures. It is desirable to limit the amount of time that an individual needs to be within the hoistway for such procedures.

Various proposals have been made for supporting elevator system components within a hoistway for a machine roomless configuration. Examples are shown in U.S. Pat. No. 6,446,762, EP 1,266,859, WO 99/43596 and EP 1,329,411. Those skilled in the art are always striving to make improvements in areas such as simplifying installation procedures, reducing costs associated with elevator system components and installation and decreasing the burden on service personnel for performing maintenance and service procedures.

SUMMARY

An exemplary mounting arrangement for an elevator machine comprises a first portion and a second portion. The first portion and the second portion are moveable relative to each other between a shipping position and a deployed position in which the first portion and the second portion are generally perpendicular to each other.

An exemplary preassembled kit for subsequent use in an elevator system comprises a mounting arrangement for components of the elevator system that includes a first portion that is configured to receive a machine and a second portion that is configured to receive control electronics that operate the elevator machine. Wiring extends between the first portion and the second portion for connecting the machine to the control electronics.

An exemplary method of installing components in an elevator system includes placing an elevator machine support near a hoistway. The elevator machine support has a first portion and a second portion in a first orientation in which the first and second portions are generally parallel to each other. At least the first portion is raised to cause relative movement between the first and second portions into a second orientation in which the first and second portions are no longer parallel to each other. The elevator machine support is raised to a level corresponding to an installation location and secured in the installation location.

The various features and advantages of the disclosed examples will become apparent to those skilled in the art from the following detailed description. The drawings that accompany the detailed description can be briefly described as follows.

DETAILED DESCRIPTION

Figure 1:
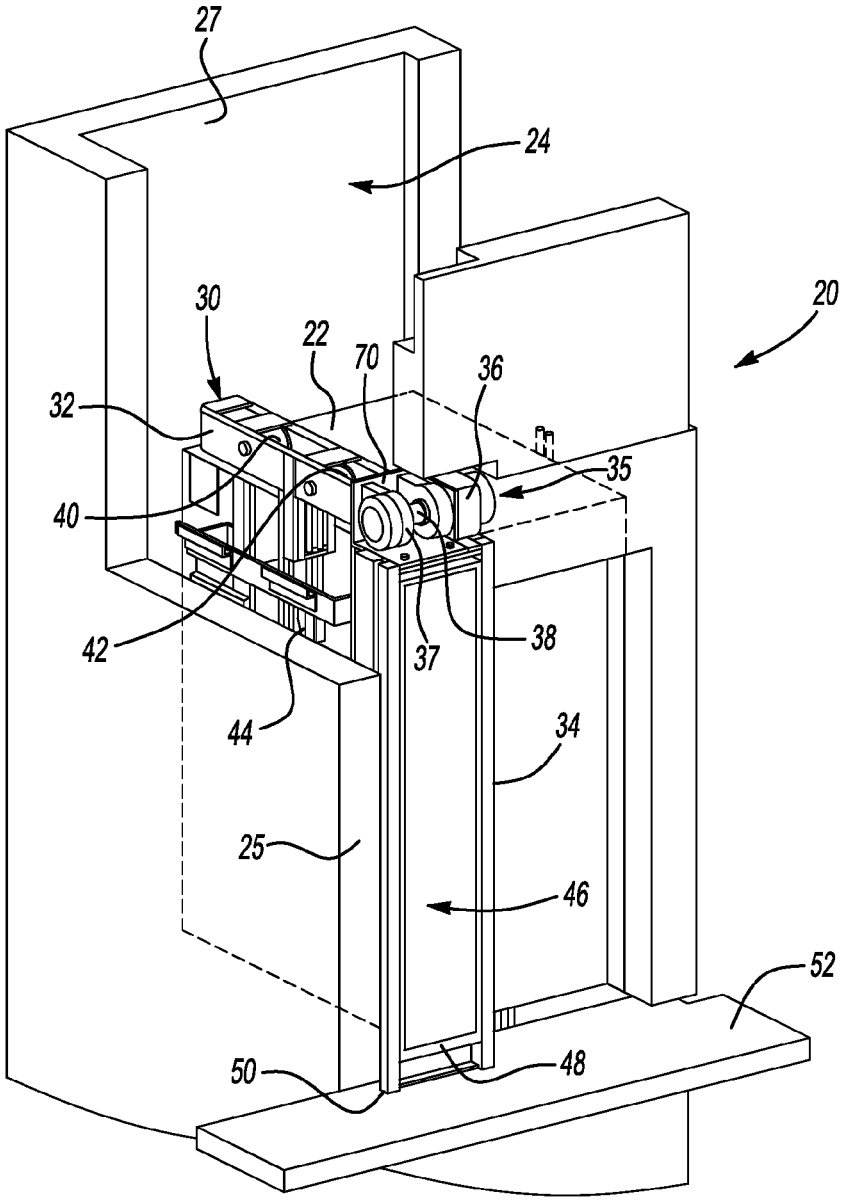
FIG. 1 diagrammatically illustrates selected portions of an elevator system including a machine support designed according to an embodiment of this invention.
Figure 2:
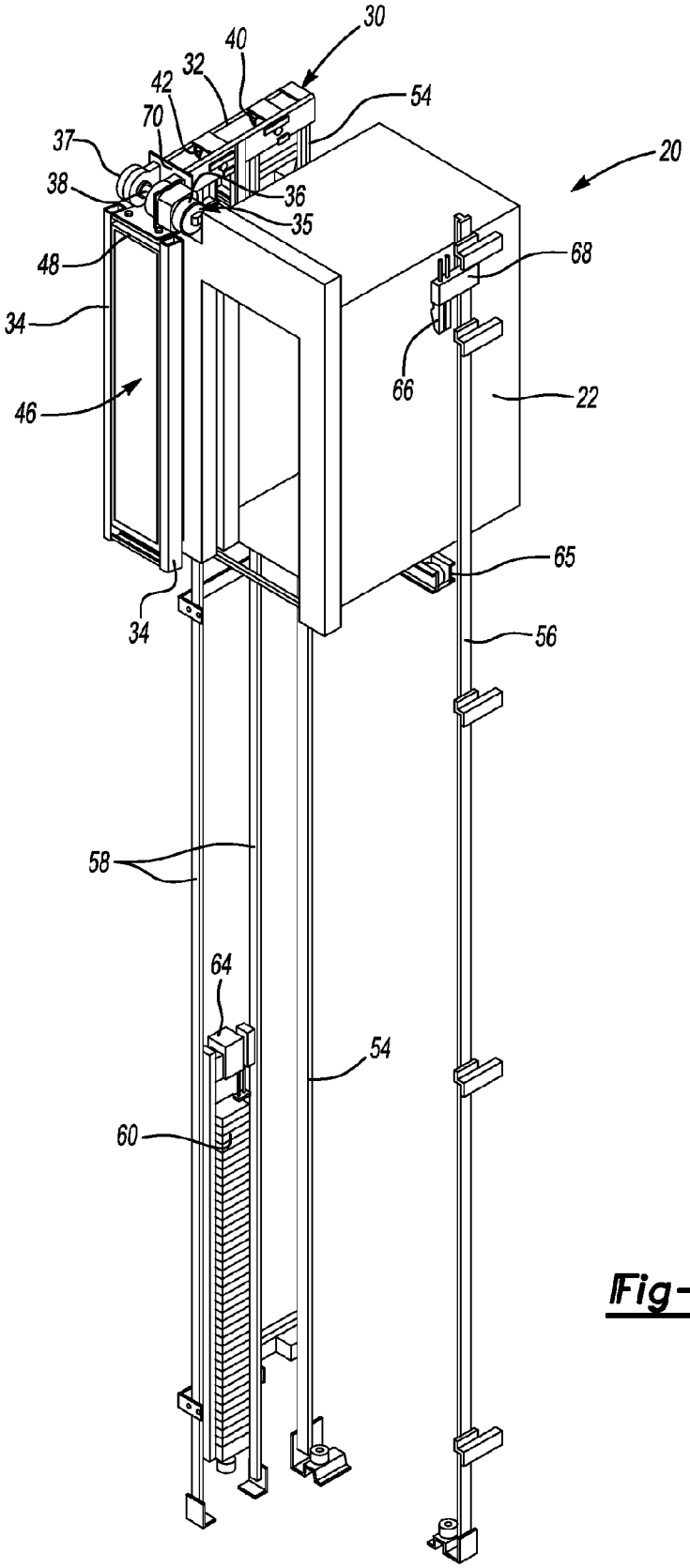
FIG. 2 diagrammatically illustrates selected features of the embodiment of FIG. 1 from another perspective.
Figure 3:
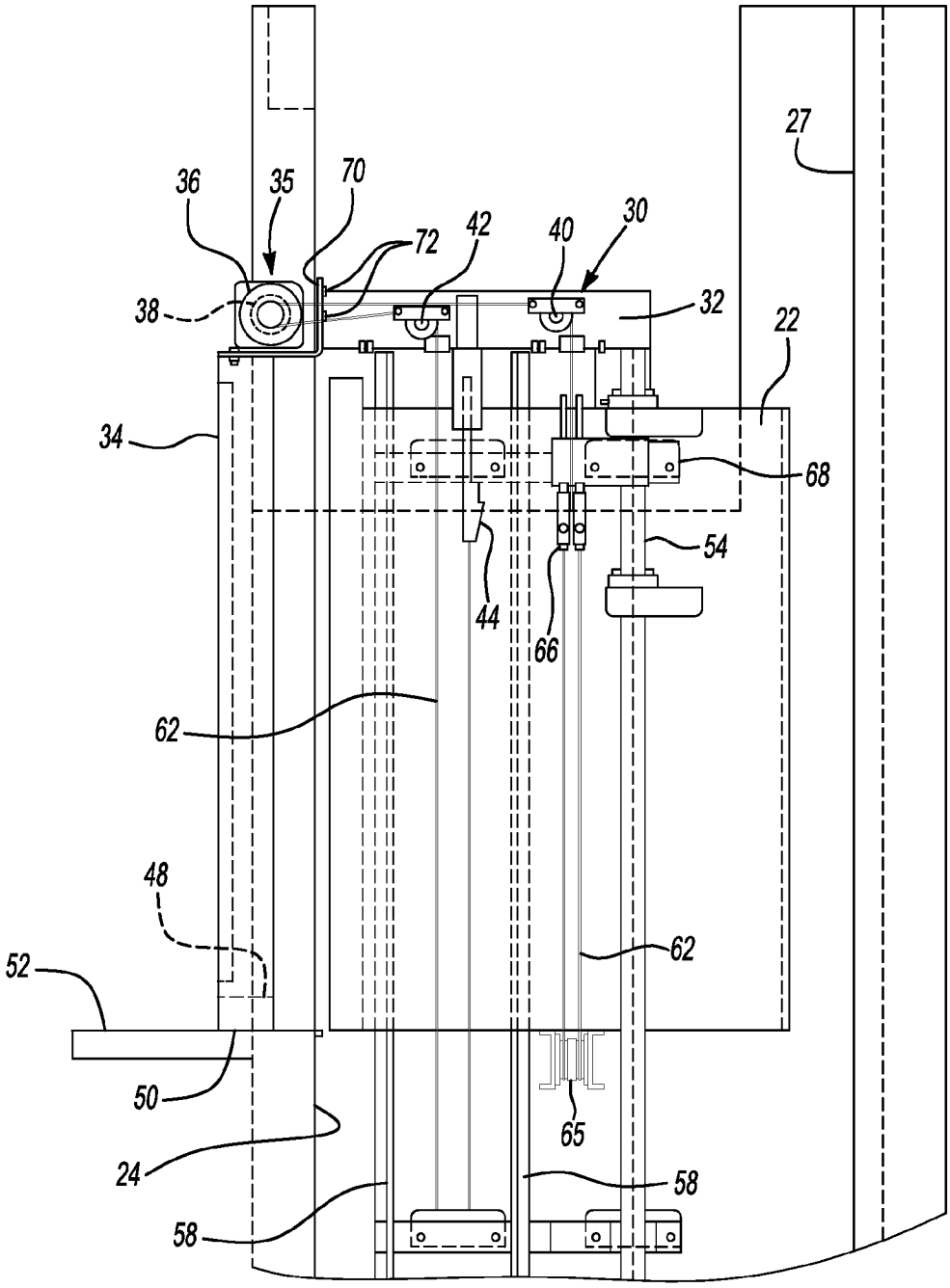
FIG. 3 is a side view illustrating selected features of the example of FIG. 1.

FIGS. 1-3 illustrate selected portions of an example elevator system 20. An elevator car 22 moves within a hoistway 24 to provide desired elevator service. An elevator machine support 30 includes a first portion 32 and a second portion 34. An elevator machine 35 (e.g., a motor 36 and brake 37) and an associated traction sheave 38 are mounted on the machine support 30. In the illustrated example, the traction sheave 38 is a part of a shaft of the motor 36. In other examples, the sheave 38 is a separate component associated with the motor shaft.

In the illustrated example, the first portion 32 of the machine support 30 is at least partially within the hoistway 24 and is aligned horizontally (e.g., generally parallel with the floor of the elevator car 22). The second portion 34 is generally perpendicular to the first portion 32. The second portion 34 in this example is located at least partially outside of the hoistway 24. The second portion 34 extends below the first portion 32 to transfer a portion of the load of the machine support 30 to the building structure outside of the hoistway 24.

The first portion 32 supports deflection sheaves 40 and 42 and a plurality of roping terminations 44. The second portion 34 supports a housing 48 useful for housing elevator system components (e.g., electronic components 46 such as the drive for controlling operation of the machine 35 and the controller general operation of the car 22). In this example, the housing 48 is positioned within an envelope of the second portion 34. In one example, the housing 48 comprises a structurally rigid material that cooperates with the structure of the second portion 34 (e.g., metal beams) such that the housing 48 at least partially bears some of the load supported by the second portion 34.

In this example, the second portion 34 has one end 50 resting upon a horizontally oriented support surface 52. In one example, the surface 52 is coincident with a floor at a landing as shown in FIG. 1. In this example, the support surface 52 is at the uppermost landing of the hoistway 24 serviced by the elevator car 22.

The support surface 52 may be spaced from a landing floor. One example includes a notched portion of a wall (e.g., a portion of the wall is removed) that includes a horizontal surface upon which the end 50 is received. Another example includes a beam having a horizontally oriented surface parallel to the floor at a selected landing. Such a beam is supported by the building structure so that the load on the beam is transferred to the associated building structure. The support surface 52 in each case is vertically below the horizontally oriented first portion 32.

Having the end 50 supported in such a way is useful for reducing the amount of the load that must be supported within the hoistway 24. The described examples facilitate transferring at least a portion of the load to the building structure outside of the hoistway.

The example arrangement of the machine support 30 provides for a substantial portion of the load of the machine 35 and the elevator system to be supported by the second portion 34 and transferred to the support surface 52 of the corresponding building. A remaining portion of the load of the machine support 30 and the associated elevator system in this example is supported by the first portion 32 and a structural member at least partially in the hoistway 24. In this example, the first portion 32 has an end opposite from the second portion 34 that is directly supported by the car guide rail 54 such that the portion of the total load that is not directly supported by the second portion 34 and the support surface 52 is supported by the first portion 32 and the car guide rail 54.

In the illustrated example, one end of the first portion 32 is supported by the second portion 34 and an opposite end is supported by the structural member at least partially in the hoistway (i.e., the guide rail 54 in this example). Having the ends of the first portion 32 supported in this manner does not require the outside edges of the first portion 32 to be aligned with the corresponding supporting structure. In other words, the second portion 34 may be positioned somewhere between a center of the first portion 32 and the corresponding end of the first portion 32. Similarly, the structural member that provides support to the first portion 32 near the other end may engage the first portion 32 somewhere between a center of the first portion 32 and the corresponding end of the first portion 32.

In the illustrated examples, the second portion 34 extends outwardly from the front wall defining the hoistway 24 in order for the elevator installation to have as little impact on the construction or refurbishment of the building as possible. If such impact is not a concern, other arrangements are possible. For example, the front wall could have a recess facing the landing or an opening to the hoistway, with the second portion located in the recess or opening.

The example machine support 30 distributes the load supported by the support between the first portion 32 and the second portion 34. In one example, approximately 40% of the total load is borne by the second portion 34 so that it is transferred to and supported by the structure of the building associated with the floor 52. Resting the end 50 of the second portion 34 on the floor 52 (e.g., a concrete slab or a structural steel member that is supported as part of the floor 52 and the associated building) reduces the amount of load that must be supported within the hoistway 24. In such an example, approximately 60% of the load is borne by the first portion 32 and the associated car guide rail 54. The amount of load supported by each portion may vary depending on the elevator duty and the hoistway size.

The illustrated example allows for supporting the vast majority of the loads of the elevator system on one side of the elevator car 22 in a convenient and economical arrangement that minimizes the space required for the elevator system within the hoistway 24 and introduces other economies associated with installing and maintaining the elevator system.

Another guide rail 56 is provided for guiding movement of the car 22 as can be appreciated from FIG. 2. Counterweight guide rails 58 are also provided for facilitating movement of a counterweight 60 that is coupled with the elevator car 22 using a roping arrangement 62. In one example, the roping arrangement 62 comprises a plurality of flat belts. Another example includes round ropes.

In this example, the roping arrangement 62 has one end supported by the terminations 44 that are supported on the first portion 32 of the machine support 30. The roping arrangement 62 follows a path from the terminations 44 around a deflection sheave 64 supported for movement with the counterweight 60 and up to the deflection sheave 42 supported on the first portion 32. The roping arrangement 62 then proceeds around the traction sheave 38, over the deflection sheave 40 and down to deflection sheaves 65 supported for moving with the elevator car 22. The roping arrangement 62 then proceeds upward to terminations 66, which in this example are supported on a bracket 68 secured to the car guide rail 56 on the opposite side of the car 22 from the machine support 30.

The illustrated example includes an under-slung arrangement having deflection sheaves 65 beneath the floor surface of the elevator car 22. Over-slung arrangements are also possible. Additionally, while a 2:1 roping ratio is shown, 1:1 or other roping arrangements can be used.

In the illustrated example, the configuration of the roping arrangement 62 results in horizontal forces on the traction sheave 38 and the machine 35 (i.e., to the right in FIG. 3). Accordingly, in this example, the machine 35 is mounted to a mounting plate 70 on the first portion 32 and secured in place using fasteners 72.

With such an arrangement the entire load of the elevator system is supported by the machine support 30, the structure of the building associated with the support surface 52 and the car guide rails 54 and 56. None of the weight of the elevator system needs to be supported by the counterweight guide rails 58. This allows for using less expensive, lighter weight materials for the counterweight guide rails 58. The movement of the counterweight 60 is the only issue addressed by the counterweight guide rails 58 in this example. Therefore, additional cost savings are possible by using lighter weight materials or different geometry configurations for the guide rails 58 associated with the counterweight 60. Another feature of the illustrated example is that the counterweight 60 can be conveniently positioned between the car guide rail 54 and a front interior wall of the hoistway 24 to provide space savings.

Although the examples in the Figures show that the counterweight rails 58 do not receive any vertical load from the machine support 30, the elevator system 20 could be designed so that the counterweight rails 58 receive some of the vertical load from the machine support 30 if desired.

One feature of this example is that the machine 35 is supported in a location where a mechanic or technician can access the components of the motor or brake of the machine 35 without having to enter the hoistway 24. In this example, the machine 35 is accessible from the landing at the floor 52. Similarly, the control electronics 46 are completely accessible at the landing floor 52. One example includes using a decorative fascia (not shown) to cover over the second portion 34, the housing 48 and the opening at which the machine 35 is accessible so that individuals in the vicinity of the elevator are not aware of the presence of those components. A mechanic or technician has ready, convenient access to all of the operative components associated with working the machine 35 from the landing floor 52. For example, a brake reset lever may be manually manipulated by an individual at the floor level 52 for resetting the elevator brake under required conditions. One feature associated with such an arrangement is that it eliminates the requirement for an electronic or remote brake release. This provides cost savings by reducing the complexity and number of components required for the brake and enhances economies associated with operating and maintaining the elevator system.

Figure 4:
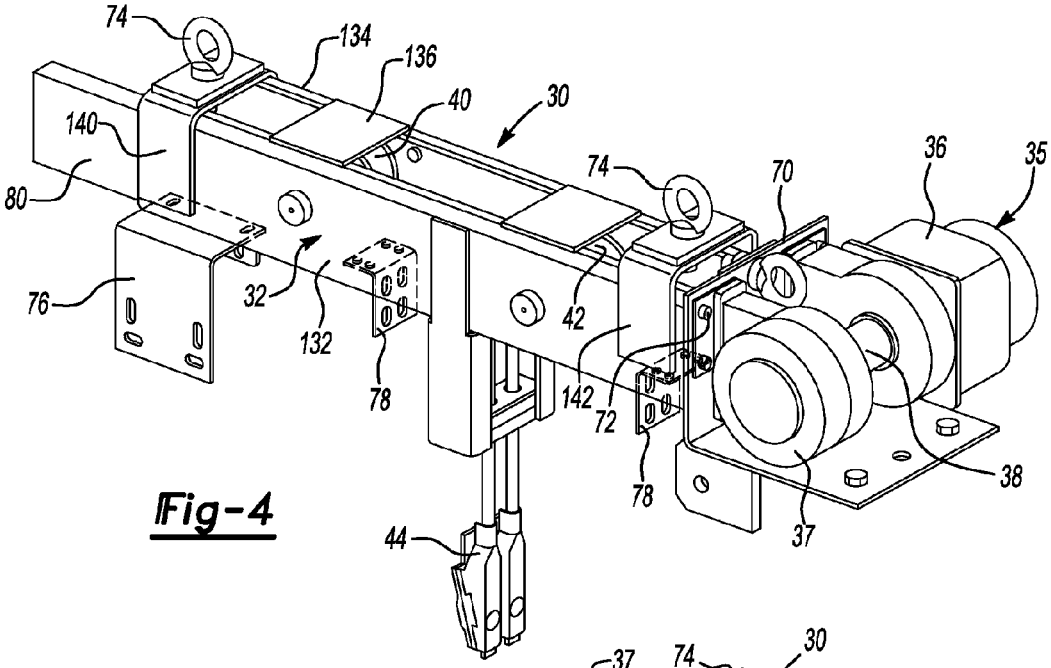
FIG. 4 diagrammatically illustrates selected portions of one example machine support.

In the examples of FIGS. 1-3, the first portion 32 is supported near one end by the second portion 34 and near an opposite end by the car guide rail 54. In the example of FIG. 4, the first portion 32 includes an eye bolt 74 that can be secured to a hanger suspended from a structural member of the associated building. This allows for supporting the first portion 32 by effectively suspending part of it from a structural member of the building located above the machine support 30. With such an arrangement, it is not necessary to support the first portion 32 on a car guide rail 54. Such an arrangement may allow for reducing the cost associated with the car guide rails as they do not need to support as much load as is required in the example of FIGS. 1-3, for example.

The example of FIG. 4 includes a mounting bracket 76 associated with the first portion 32 near one end of the first portion 32. The mounting bracket 76 in this example allows for securing the first portion 32 in a desired position relative to a sidewall of the hoistway 24. The mounting bracket 76 need not be a load supporting mounting bracket but it can operate to transfer some load to the hoistway wall in some examples. An intended feature of the mounting bracket 76 is to secure the machine support 30 in a desired location relative to the hoistway walls to provide accurate positioning of the elevator system components.

The example of FIG. 4 also includes mounting brackets 78 that are useful for securing the upper end of the counterweight guide rails 58 in a desired location within the hoistway 24.

The first portion 32 in this example comprises side beams 132 and 134. A plurality of plates 136, 138 span a space between the side beams 132 and 134. Generally U-shaped brackets 140 and 142 are secured near ends of the side beams 132 and 134. All of these pieces in this example comprise metal and are welded together.

One other feature of the example shown in FIG. 4 is that a governor device 80 is supported by the first portion 32 of the machine support 30. Supporting a governor device 80 on the first portion 32 is also possible in the example of FIGS. 1-3 although a governor device 80 is not specifically illustrated in those drawings nor is it required in such a position in any of the examples. In some examples, the governor device is pre-installed on the first portion 32 prior to the machine support 30 being installed in the hoistway 24.

In the examples of FIGS. 1-3 and 4, the axis of rotation of the traction sheave 38 is oriented parallel to the front wall of the hoistway 24 (i.e., the wall defining a front of the hoistway). The motor 36 including the shaft of the motor and the brake 37 extend along the same wall. At least a portion of the machine 35 is within a boundary of that wall as can be appreciated in FIGS. 3 and 7.

Figure 5:
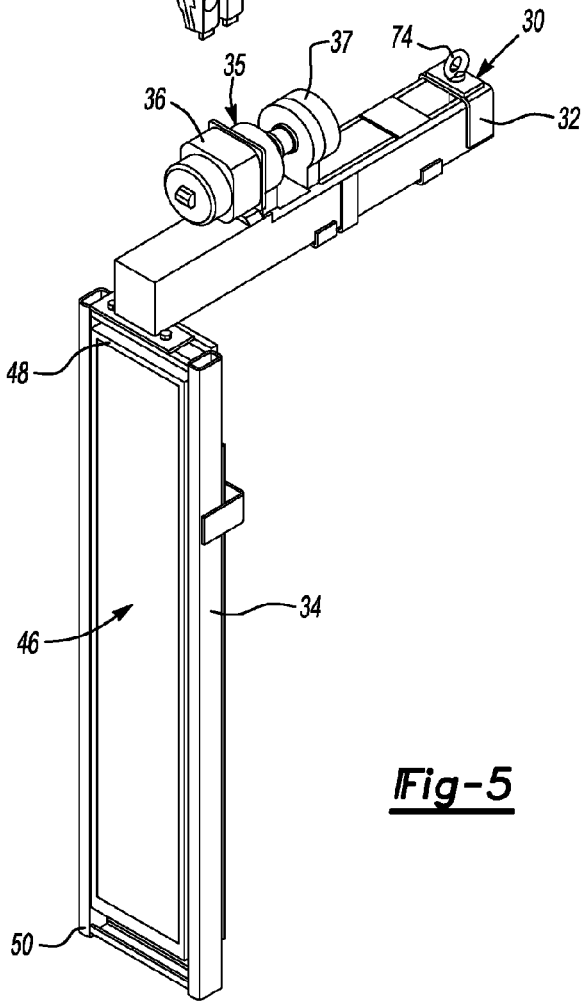
FIG. 5 schematically illustrates selected portions of another example arrangement of an elevator system.

The example of FIG. 5 includes the machine 35 supported on the first portion 32 such that the axis of rotation of the traction sheave 38 is parallel to a side wall of a hoistway. The motor 36 including the shaft of the motor and the brake 37 extend along the same wall. At least a portion of the machine 35 is within a boundary of that wall as can be appreciated in FIGS. 3 and 7. With the embodiment of FIG. 5 the path followed by the roping arrangement 62 will be modified compared to that in the example of FIGS. 1-3. Given this description, those skilled in the art will be able to provide a suitable roping arrangement configuration to meet their needs for a particular elevator system.

In the examples of FIGS. 1-5, the first portion 32 of the machine support 30 is located on one side of the hoistway 24 as can be appreciated from FIG. 1, for example. In other words, the first portion 32 of the machine support 30 in the examples of FIGS. 1-5 resides in the top part of the hoistway 24 in the space between the sidewall 25 defining the hoistway 24 and the space needed by the elevator car 24 on its path along the rails 54, 56. The first portion 32 may be in the overhead extension of the space needed by the car 22.

Figure 6:
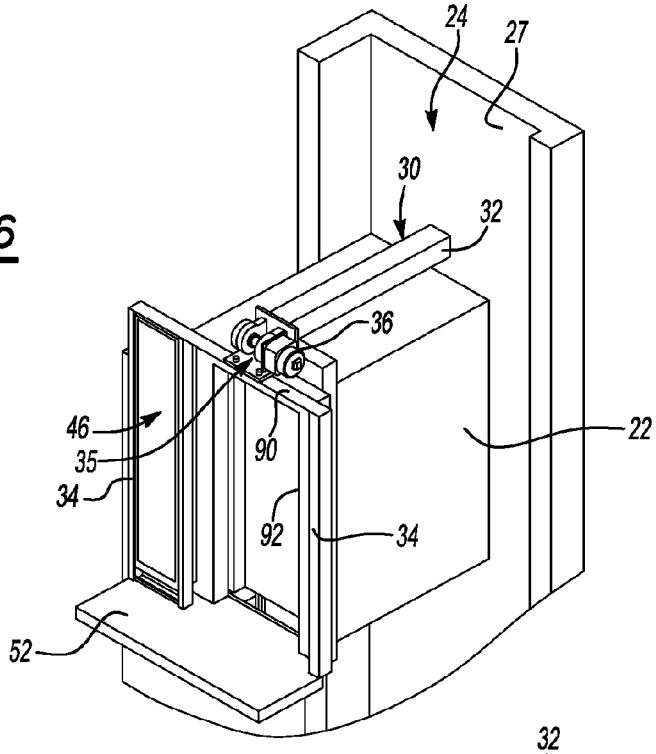
FIG. 6 schematically illustrates another example arrangement of an elevator system.

FIG. 6 schematically illustrates another arrangement where the first portion 32 is centered above an opening 92 for the car doors of the elevator car 22 and resides in the overhead extension of the space needed by the elevator car 24 on its path along the rails 54, 56. In this example, the second portion 34 includes some support elements on one side of the elevator door opening 92 at the landing of the floor 52 and other support elements on an opposite side of the door opening. In the example of FIG. 6, a crossbeam 90 is positioned above the elevator car door opening 92. One end of the first portion 32 near the machine 35 is supported on the crossbeam 90. In this example, an opposite end of the first portion 32 is supported by the building structure along the rear wall defining the hoistway 24. In another example, the first portion 32 is suspended from an overhead structural member above the machine support 30 so that the loads carried by the machine support 30 are transferred to the building structure including having a substantial portion of the load (e.g., 40%) transferred to the support surface 52 and the associated building structure (e.g., a floor surface or at least one structural member vertically below the first portion 32).

Figure 7:
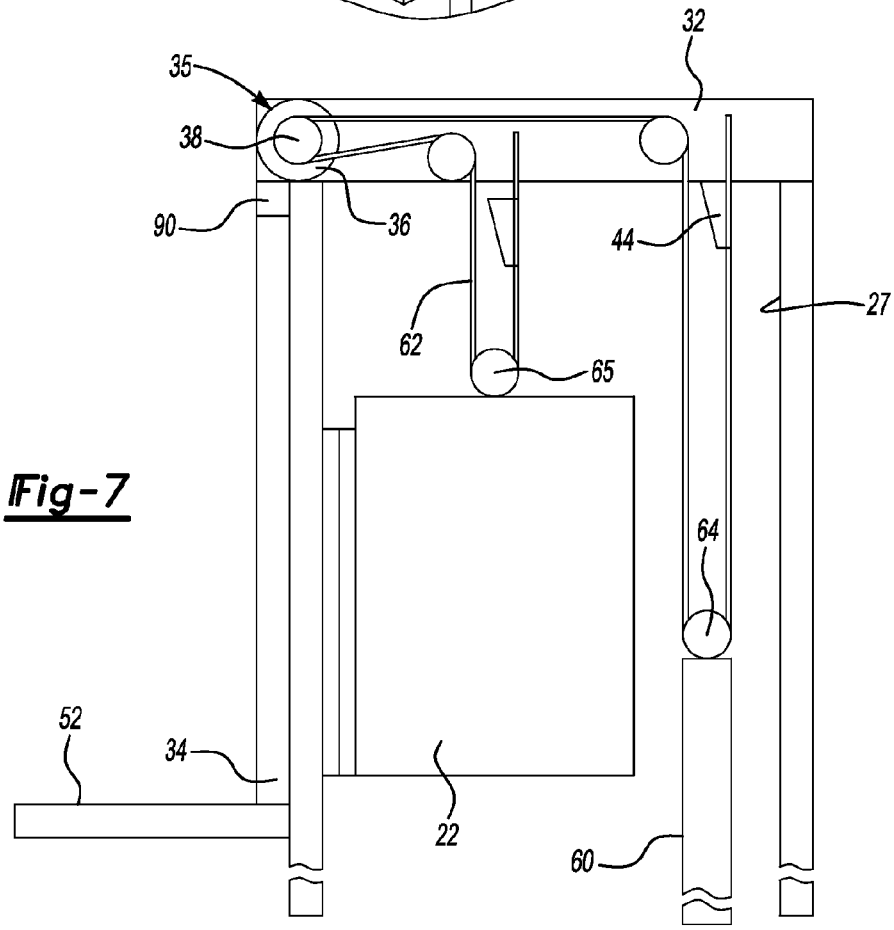
FIG. 7 schematically illustrates selected features of the example of FIG. 6.

FIG. 7 schematically shows a side view of the example of FIG. 6. In this example, the counterweight 60 is located behind the elevator car 22 rather than being on the side of it as in the example of FIGS. 1-3. The elevator car 22 includes the deflection sheave 65 on top of the car 22 rather than having an underslung arrangement as in the example of FIGS. 1-3. Although this example shows an over-slung arrangement in the Figures, other arrangements are also possible with this example. For instance, the roping arrangement 62 could terminate on the top of the car 22.

Another feature of the example of FIGS. 6 and 7 is that the machine support 30 does not need to be supported on any of the guide rails for the elevator car 22 or the counterweight 60. Instead, the first portion 32 of the machine support 30 is supported by the rear wall 27 defining the hoistway 24 using a suitable mounting arrangement or a notch in that wall. Although described with this example, all of the other described examples could mount the first portion 32 to the rear wall 27 (or the sidewall 25) defining the hoistway 24. In each instance, the corresponding wall is considered at least partially within the hoistway 24. Accordingly, all of the guide rails 54, 56 and 58 may be made from a lightweight material and do not have the same structural constraints on them compared to elevator systems where the guide rails support the vertical load. In the example of FIG. 7, the terminations for the roping arrangement 62 are all supported by the first portion 32 of the machine support 30. Being able to use lighter weight materials for the guide rails provides cost savings, for example.

Additionally, where the guide rails in the elevator system do not need to support vertical loads, it is possible to secure the rails in position at fewer locations along the height of the hoistway 24. This provides a material savings in that fewer mounting brackets are required for the guide rails. Additionally, less installation time is required for installing the rails.

The first portion 32 and second portion 34 of the machine support 30 could be attached together using any suitable method. For example, the first portion 32 and second portion 34 could be permanently affixed together. In these examples, the first portion 32 and the second portion 34 could be welded together (either prior to or after installation in the hoistway 24). In other examples, the first portion 32 and second portion 34 could be removably mounted together. In these examples, an individual could manually secure the two portions relative to each other in a desired orientation (e.g., perpendicular) using, for example, fasteners at any desired point such as while the machine support 30 is still located near the lowermost landing of the hoistway 24 or after positioning the first portion 32 and second portion 34 in their final installation positions relative to the hoistway.

Figure 8:
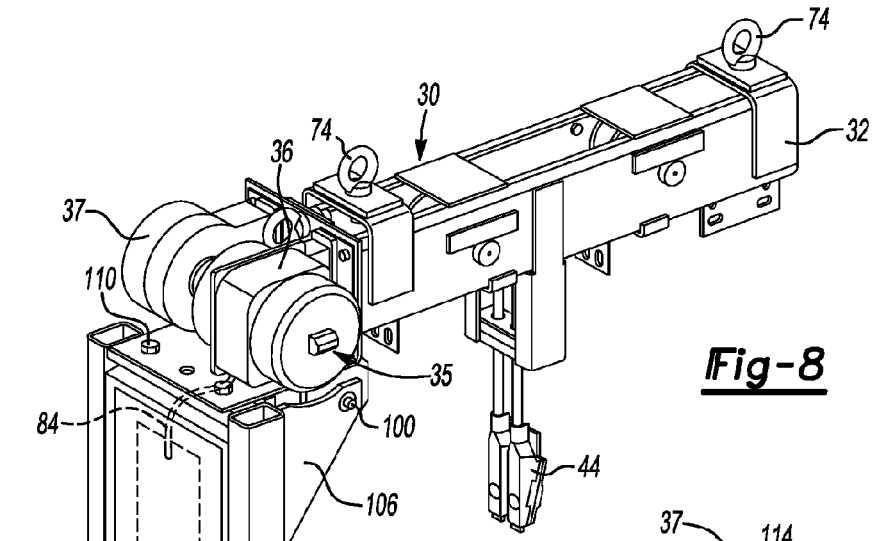
FIG. 8 diagrammatically illustrates an example machine support having components of the support in a first orientation.
Figure 9:
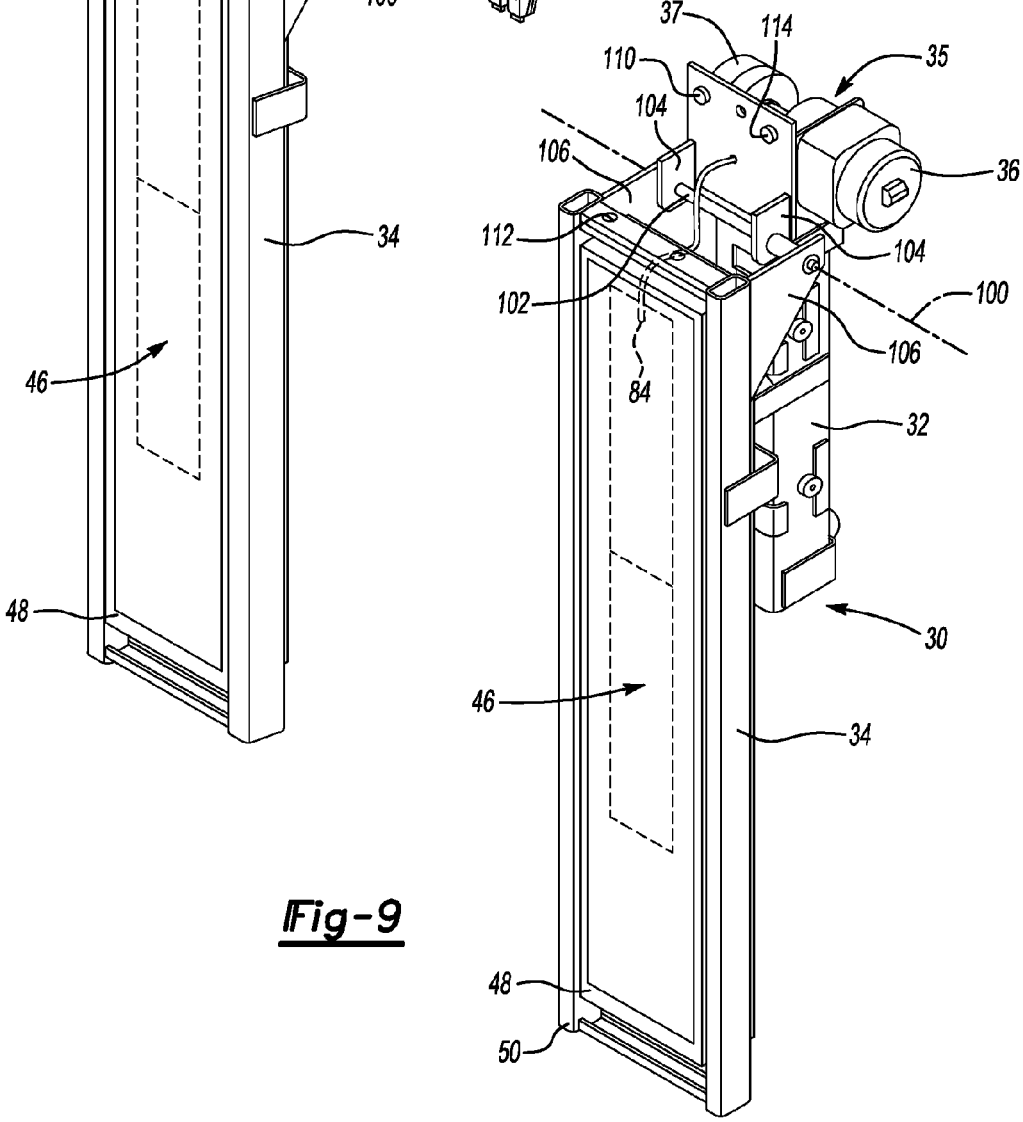
FIG. 9 diagrammatically illustrates the example of FIG. 8 having the machine support components in a second orientation.

FIG. 8 diagrammatically illustrates an example arrangement where the first portion 32 and the second portion 34 are pivotally secured together so that one portion can pivot relative to the other. In the example of FIG. 8, relative pivotal motion between the first portion 32 and the second portion 34 occurs about a pivot axis 100. The first portion 32 and second portion 34 are selectively moveable relative to each other from a first orientation in which the two portions are generally parallel to each other as shown in FIG. 9 into a second orientation in which the two portions are generally perpendicular to each other as shown in FIG. 8, for example. The first orientation can be the position of the machine support 30 when shipping the pre-assembled kit to the installation. The second orientation can be the position of the machine support when finally installed in the hoistway 24.

As best appreciated from FIG. 9, a rod 102 extends through openings in flanges 104 associated with the first portion 32 and flanges 106 associated with the second portion 34. In this example, the centerline of the rod 102 is coincident with the pivot axis 100 about which the two portions can move relative to each other.

One feature of this example is that the machine support 30 with all of the pre-mounted components such as the control electronics 46, the machine 36, the terminations 44 and a governor 80 with all of the components pre-connected and pre-wired can be delivered to an installation site in the configuration shown in FIG. 9. During an example installation procedure, the first portion 32 and second portion 34 are manipulated relative to each other such that they pivot about the pivot axis 100 and eventually are moved into the orientation shown in FIG. 8. This example includes fasteners 110 that are received through openings 112 in the second portion 34 and corresponding openings 114 in the first portion 32. The fasteners may comprise nuts and bolts in one example. The fasteners 110 secure the two portions relative to each other in a desired orientation upon proper installation in an elevator system.

One feature of having multiple components pre-installed onto the machine support 30 prior to installation in the hoistway 24 is that greater efficiency during elevator installation becomes possible. As shown in FIGS. 8 and 9, the example assembly includes wiring 84 extending between various components supported on the first portion 32 and the second portion 34. This allows the control electronics 46 and the machine 35, for example, to be pre-wired and pre-connected with those components in their desired positions on the machine support 30 prior to installation in the hoistway. Additionally, other components could be pre-connected and pre-wired. For example, a governor device 80 could also be mounted to the machine support and pre-wired to the control electronics 46 through the wiring 84. The pre-wiring and pre-connection of the components could take place at the factory (allowing the testing of the various components and connections prior to shipment to the installation) or, if desired, at any downstream step prior to installation of the machine support 30 at its final position at the top of the hoistway 24. Making all of the necessary connections between the various electronic components, switches, etc. and shipping this preassembled kit reduces the amount of work required during the installation of the components in the hoistway 24 for use in the elevator system 20. This allows for a streamlined installation procedure.

In addition to the components that require wiring, other components of the elevator system 20 could be shipped already installed on the machine support 30 to the installation location. For example, the diverter sheaves 40, 42 can be pre-mounted on the machine support 30 prior to shipment. In other instances, these components could be shipped with the machine support 30 but not pre-mounted. For example, pre-mounting the terminations 44 in some examples may not allow the machine support 30 to reach its full shipping position as shown in FIG. 9 and in that case the terminations would not be installed until the kit reaches its intended destination. In addition, ends of the load bearing members (e.g., flat belts) used as the roping arrangement 62 could be placed in the terminations 44 prior to shipment.

Figure 10A:
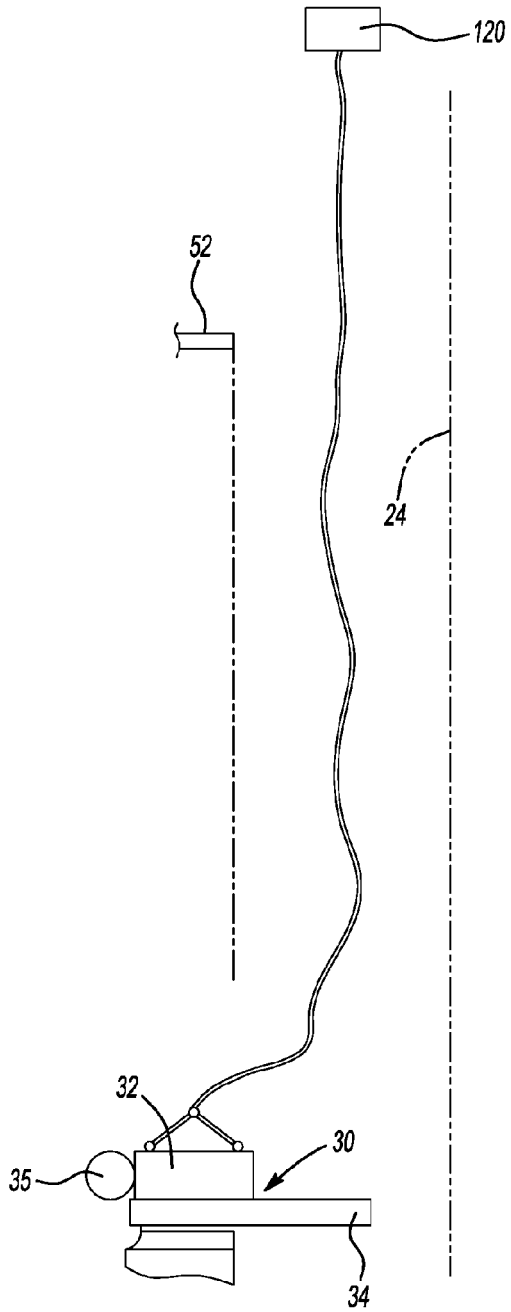
FIGS. 10A-10D schematically illustrate an example installation procedure.

FIGS. 10A-10D schematically illustrate an example installation procedure. The pre-assembled kit arrives at the installation. As shown in FIG. 10A, the machine support 30 with preloaded components has the first portion 32 and second portion 34 in a first orientation in which they are generally parallel to each other. The kit is delivered to the installation site and is placed near the hoistway 24. The machine support 30 is then manipulated at least partially into the hoistway 24. A hoisting device 120 is connected with eye bolts 74 for lifting the machine support 30 and associated components up to an installation position at the top of the hoistway in this example.

Figure 10B:
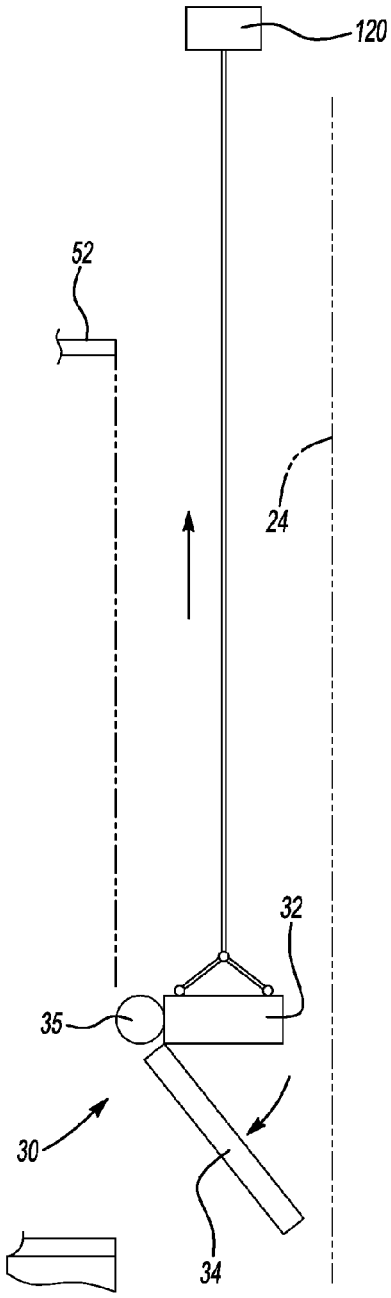

As shown in FIG. 10B, the first portion 32 and second portion 34 are allowed to move relative to each other and the initial lifting of the machine support 30 using the hoisting device 120 causes separation between them such that they move out of the first orientation where the two portions are parallel to each other. In this example, gravity assists in causing relative movement between the portions such that the second portion 34 becomes spaced downward and away from the first portion 32 as there is movement about the pivot axis 100. In other words, lifting at least the first portion 32 while allowing the second portion 34 to be suspended about the pivot axis 100 moves the two portions into an orientation in which the two portions are no longer parallel to each other.

In one example, a locking feature 130 is provided to at least temporarily lock the second portion 34 into a fixed position relative to the first portion 32 when the two portions move relative to each other into a substantially perpendicular orientation (e.g., cooperating tabs or surfaces that move into an abutting relationship). In some examples, an automatic locking feature holds the first portion 32 relative to the second portion 34 in a desired orientation until a subsequent portion of the installation process in which the fasteners 110 are used for more permanently securing the two portions relative to each other in a desired installation orientation.

In other examples, an individual manually secures the two portions relative to each other in a desired orientation (e.g., perpendicular) while the machine support 30 is still located near the lowermost landing of the hoistway 24.

Figure 10C:
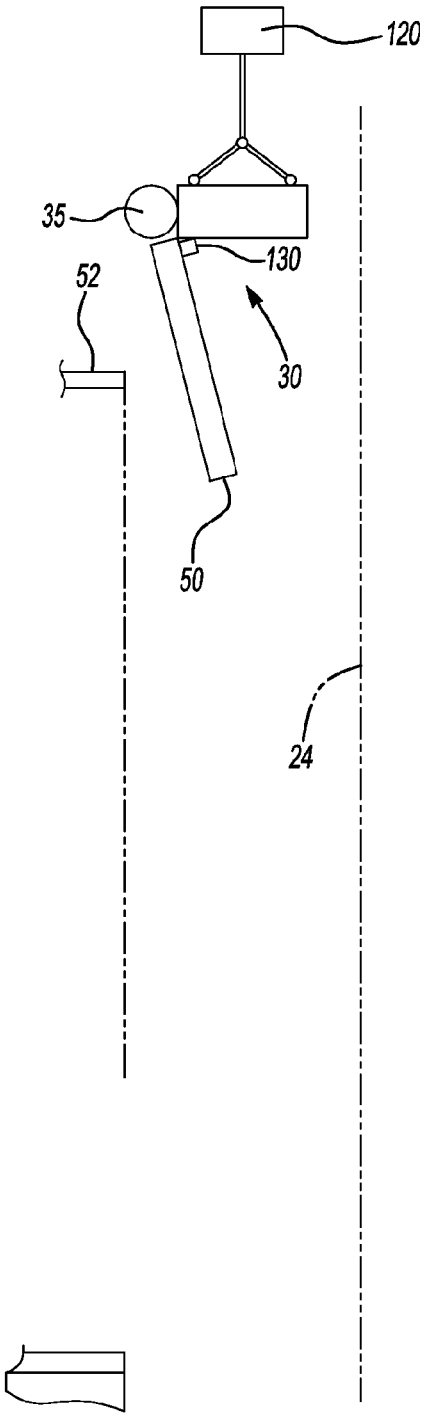
Figure 10D:
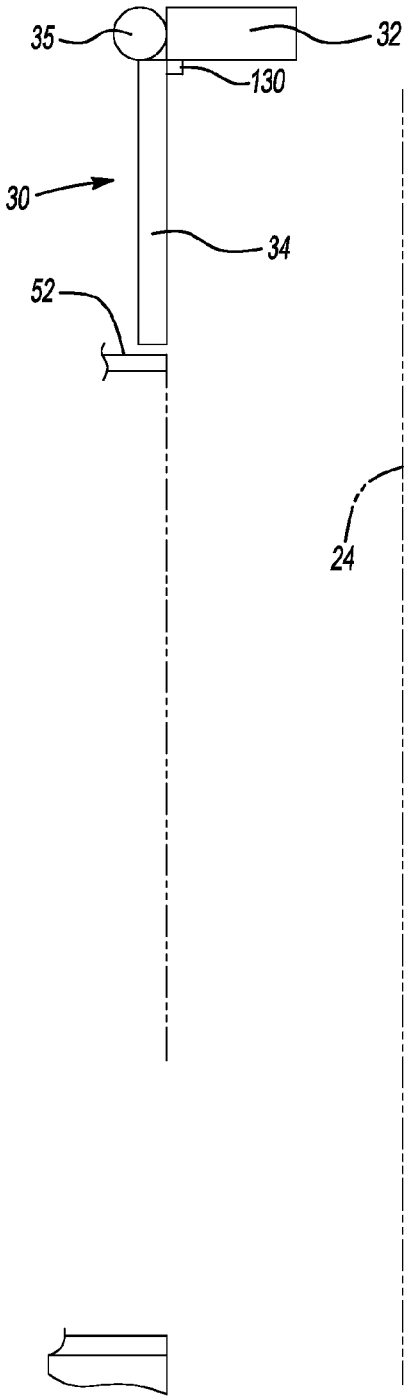

As schematically shown in FIG. 10C, the hoisting device 120 is used to lift the machine support 30 and the associated, pre-mounted components up to an installation location near the top of the example hoistway 24. At that location, an individual can manually position the second portion 34 such that the end 50 rests upon the floor 52 and then secure the opposite end of the first portion 32 by either arranging for it to be supported on the elevator car guide rail 54 or to be suspended from a structural member above the eye bolt 74, depending on the particular installation configuration.

Once secured in position, a significant portion of the elevator system installation is completed because all of the connections required between the machine 36 and the control electronics 46 are already made. In examples where the governor 80 is pre-mounted to the machine support 30, those control connections are also made. Additionally, terminations 44 are already in location relative to the machine support 30. The brackets 78 (best seen in FIG. 4) facilitate readily placing the counterweight guide rails 58 in position within the hoistway 24. The diverter sheaves 40 and 42 are already in a desired alignment relative to the traction sheave 38. The disclosed examples facilitate an enhanced elevator system installation process that saves significant time and material costs associated with installing elevator systems.

In one estimation, an entire elevator within a single hoistway can be installed in a single day by four individuals when using at least some of the features of the disclosed examples. Reducing the amount of time required for elevator system installation, by as much as two thirds in some examples, provides significant cost savings.

The disclosed examples provide added features such as having the machine 36 and control electronics 46 all accessible from an upper floor 52 of the building without requiring an individual to enter the hoistway to perform many maintenance procedures.

The disclosed examples provide added features such as having the machine 35 and any components of the elevator system in the housing 48 all accessible from an upper floor 52 of the building without requiring an individual to enter the hoistway to perform many maintenance procedures.

The preceding description is illustrative and not limiting. A worker of ordinary skill in the art would recognize that certain modifications to the disclosed examples are possible and that features described in one example are not necessarily limited to that example and could be used in another example. For that reason, the following claims should be studied to determine the scope of legal protection provided to this invention.

We claim:

1. A mounting arrangement an elevator machine, comprising:

a first portion; and a second portion hingedly connected to the first portion;

wherein the first portion and the second portion are moveable relative to each other between a shipping position and a deployed position in which the first portion and the second portion are generally perpendicular to each other and wherein the first and second portion support the elevator machine during operation of the elevator system.

2. The mounting arrangement of claim 1, comprising:

wiring extending between the first portion and the second portion for connecting the machine that can mount to the first portion to control electronics that can mount to the second portion.

3. The mounting arrangement of claim 1, wherein the first portion and the second portion establish a generally L-shaped frame that supports the elevator machine.

4. The mounting arrangement of claim 1, comprising:

at least one deflector sheave supported on the first portion.

5. The mounting arrangement of claim 1, comprising:

at least one termination for a roping arrangement for the elevator system.

6. The mounting arrangement of claim 1, comprising:

a governor device supported on the machine support.

7. The mounting arrangement of claim 1, comprising:

a plurality of rail mounting brackets supported on the first portion for positioning the guide rails in the hoistway.

8. A preassembled kit for subsequent use in an elevator system, comprising:

a mounting arrangement for components of the elevator system, including:

a first portion that is configured to receive a machine; and a second portion that is configured to receive control electronics that operate the elevator machine, the first and second portions being hingedly connected to each other; and wiring extending between the first portion and the second portion for connecting the machine to the controller.

9. The kit of claim 8, wherein the first portion and the second portion are moveable relative to each other between a shipping position and a deployed position in which the first portion and the second portion are generally perpendicular to each other.

10. The kit of claim 9, wherein the first portion and the second portion establish a generally L-shaped frame that provides support for the elevator machine.

11. The kit of claim 8, comprising:

at least one deflector sheave supported on the first portion.

12. The kit of claim 8, comprising:

at least one termination for a roping arrangement for the elevator system.

13. The kit of claim 8, comprising:

a governor device supported on the machine support.

14. The kit of claim 8, comprising:

a plurality of rail mounting brackets supported on the first portion for positioning guide rails in the hoistway.

15. A method of installing components in an elevator system, comprising the steps of:

placing an elevator machine support near a hoistway, the elevator machine support having a first portion and a second portion in a first orientation in which the first and second portions are generally parallel to each other;

raising at least the first portion to cause relative movement between the first and second portions into a second orientation in which the first and second portions are no longer parallel to each other;

raising the elevator machine support to a level corresponding to an installation location orienting the first and second portions to be generally perpendicular to each other in the installation location; and securing the elevator machine support in the installation location.

16. The method of claim 15, wherein the first and second portions establish a generally L-shaped frame to support the elevator machine in the installation location.

17. The method of claim 16, comprising locking the first and second portions generally perpendicular to each other before moving the elevator machine support into the installation location.

18. The method of claim 15, comprising moving the elevator machine support at least partially into the hoistway;

securing the first portion to a hoisting mechanism; and performing the raising at least the first portion within the hoistway.

19. The method of claim 15, comprising placing one end of the second portion on a floor at a landing for the elevator system such that at least a selected portion of a load of the elevator machine support is supported by the floor.

20. The method of claim 19, wherein one end of the first portion is supported by the second portion and the method comprises positioning a support between the one end and an opposite end of the first portion such that a remaining percentage of the weight of the elevator machine support is supported by the support.

21. The method of claim 20, wherein the support comprises a guide rail.

22. The method of claim 20, wherein the support comprises a hanger coupled to a structural member above the first portion.

* * * * *